US012055144B2

(12) United States Patent
Andreis et al.

(10) Patent No.: US 12,055,144 B2
(45) Date of Patent: Aug. 6, 2024

(54) PUMP PARTICULARLY FOR PUMPING A LIQUID SUCH AS INK, PAINT, GLUE OR THE LIKE

(71) Applicant: FLUID-O-TECH S.R.L., Corsico (IT)

(72) Inventors: Diego Andreis, Milan (IT); Pierpaolo Lucchesi, Milanino (IT); Stefano Copelli, Cusano Milanino (IT); Carlo Gonella, Saluzzo (IT)

(73) Assignee: FLUID-O-TECH S.R.L., Corsico (IT)

( * ) Notice: Subject to any disclaimer, the term of this patent is extended or adjusted under 35 U.S.C. 154(b) by 336 days.

(21) Appl. No.: 17/168,703

(22) Filed: Feb. 5, 2021

(65) Prior Publication Data

US 2021/0246896 A1 Aug. 12, 2021

(30) Foreign Application Priority Data

Feb. 7, 2020 (IT) ..... 102020000002434

(51) Int. Cl.

| | |
|---|---|
| ***F01C 1/08*** | (2006.01) |
| ***F01C 21/00*** | (2006.01) |
| ***F04C 2/08*** | (2006.01) |
| ***F04C 15/00*** | (2006.01) |
| ***F04C 29/00*** | (2006.01) |
| ***F04C 29/02*** | (2006.01) |
| *F04C 13/00* | (2006.01) |

(52) U.S. Cl.

CPC ..... *F04C 2/084* (2013.01); *F01C 1/084* (2013.01); *F01C 1/08* (2013.01); *F04C 13/002* (2013.01); *F04C 2240/30* (2013.01); *F04C 2240/50* (2013.01); *F04C 2240/60* (2013.01)

(58) Field of Classification Search

CPC ..... F04C 2/084; F04C 29/00; F04C 29/02; F04C 2/08; F01C 1/084; F01C 21/00; F01C 21/04

See application file for complete search history.

(56) References Cited

U.S. PATENT DOCUMENTS

| | | | | |
|---|---|---|---|---|
| 2,567,699 A * | 9/1951 | Devlin | ..... | F04C 2/084 418/153 |
| 5,667,372 A | 9/1997 | Hwang et al. | | |
| 6,123,531 A * | 9/2000 | Blume | ..... | F04C 2/14 418/83 |

(Continued)

FOREIGN PATENT DOCUMENTS

| | | | | |
|---|---|---|---|---|
| DE | 102005056909 A1 * | 5/2007 | ..... | F04C 15/0046 |
| EP | 1164293 A2 | 12/2001 | | |
| JP | 2009052481 A | 3/2009 | | |

OTHER PUBLICATIONS

English translation of DE102005056909 by PE2E Jan. 3, 2023.*

*Primary Examiner* — Deming Wan

(74) *Attorney, Agent, or Firm* — CANTOR COLBURN LLP

(57) ABSTRACT

A pump particularly for pumping a liquid such as ink, paint, glue or the like, includes at least one rotating pumping member having a respective shaft. The at least one rotating pumping member being at least partially housed inside a pump body, the shaft being rotatably supported by at least one support associated with the pump body.

The shaft has on its external cylindrical surface in contact with the liquid one, or more recesses, or the at least one support includes on its internal cylindrical surface in contact with the liquid, one or more recesses.

9 Claims, 4 Drawing Sheets

(56) References Cited

U.S. PATENT DOCUMENTS

| | | | | |
|---|---|---|---|---|
| 10,022,977 | B2 | 7/2018 | Mitsuo et al. | |
| 2016/0084252 | A1* | 3/2016 | Yamazaki | F04C 29/12 418/97 |

* cited by examiner

PUMP PARTICULARLY FOR PUMPING A LIQUID SUCH AS INK, PAINT, GLUE OR THE LIKE

CROSS-REFERENCE TO RELATED APPLICATIONS

This application is related to and claims the benefit of Italian Patent Application No. 102020000002434, filed on Feb. 7, 2020, the contents of which are herein incorporated by reference in its entirety.

TECHNICAL FIELD

The present disclosure relates to a pump particularly for pumping a liquid such as ink, paint, glue or the like.

BACKGROUND

The devices designed to pump inks, paints, glues or similar liquids generally comprise a pump, often of the volumetric type, used to pump such liquids inside the hydraulic circuits of such devices.

For example, with reference to the printing industry, ink pumps used in ink printers, such as ink jet printers, may be mentioned. As is known, there is a multitude of different inks which vary according to the characteristics of the printer, the material to be printed on, the ink drying speed, the type of pigment used in the ink and numerous other factors.

In the paint sector, pumps are instead used for example in paint dispensing devices. As with inks, there is a multitude of different paints with different physical properties, suitable for specific applications.

In the pumps used in these types of applications, the pumped liquid floods the thin gap between the components in relative motion to each other, such as for example the gap that is present between the rotating shafts that drive the pumping members (e.g., gear wheels in the case of volumetric pumps) and the relative supports or bearings.

However, it has been found that liquids such as inks, paints, glues or the like are subject to a phenomenon of "deposition" of a thin layer of liquid on the walls of the components in relative motion to each other. This phenomenon occurs because of the tendency of the liquid to adhere and/or to anchor itself to the walls of the components, due to the rheology of the liquid.

This "deposition" of a thin layer of liquid causes a decrease in the space available to the movement of the liquid, thus increasing the resistance to the motion of the components in relative motion to each other. This phenomenon, in addition to increasing the risk of wear of the pump, due to frictions generated by the components, can also lead to the pump, and, ultimately, to the devices in which it is adopted (e.g., printers, paint dispensers, or other devices or plants) being blocked.

As said, this problem concerns inks and paints, but also glues and other types of liquids which have a tendency to the above-mentioned "deposition" phenomenon.

SUMMARY

The present disclosure provides a pump, particularly for pumping a liquid such as ink, paint, glue or the like, which solves the drawbacks disclosed above of the prior art, allowing the aforesaid "deposition" phenomenon to be prevented.

Within the scope of this task, an the present disclosure provides a pump which does not experience premature wear or operating blocks.

The disclosure provides a pump which is easy to realise and assemble.

The disclosure further provides a pump which is capable of giving the greatest assurances of reliability and safety in use.

The disclosure also provides a pump which is economically competitive when compared to the prior art.

The above task, as well as the advantages mentioned and others which will become better apparent hereinafter, are achieved by providing a pump particularly for pumping a liquid such as ink, paint, glue or the like as recited in claim 1.

Other features are comprised in the dependent claims.

BRIEF DESCRIPTION OF THE DRAWINGS

Further characteristics and advantages will become better apparent from the description of a preferred but not exclusive embodiment of a pump particularly for pumping a liquid such as ink, paint, glue or the like, illustrated only by way of a non-limitating example in the accompanying drawings, wherein.

DETAILED DESCRIPTION OF THE DRAWINGS

Figure 1:
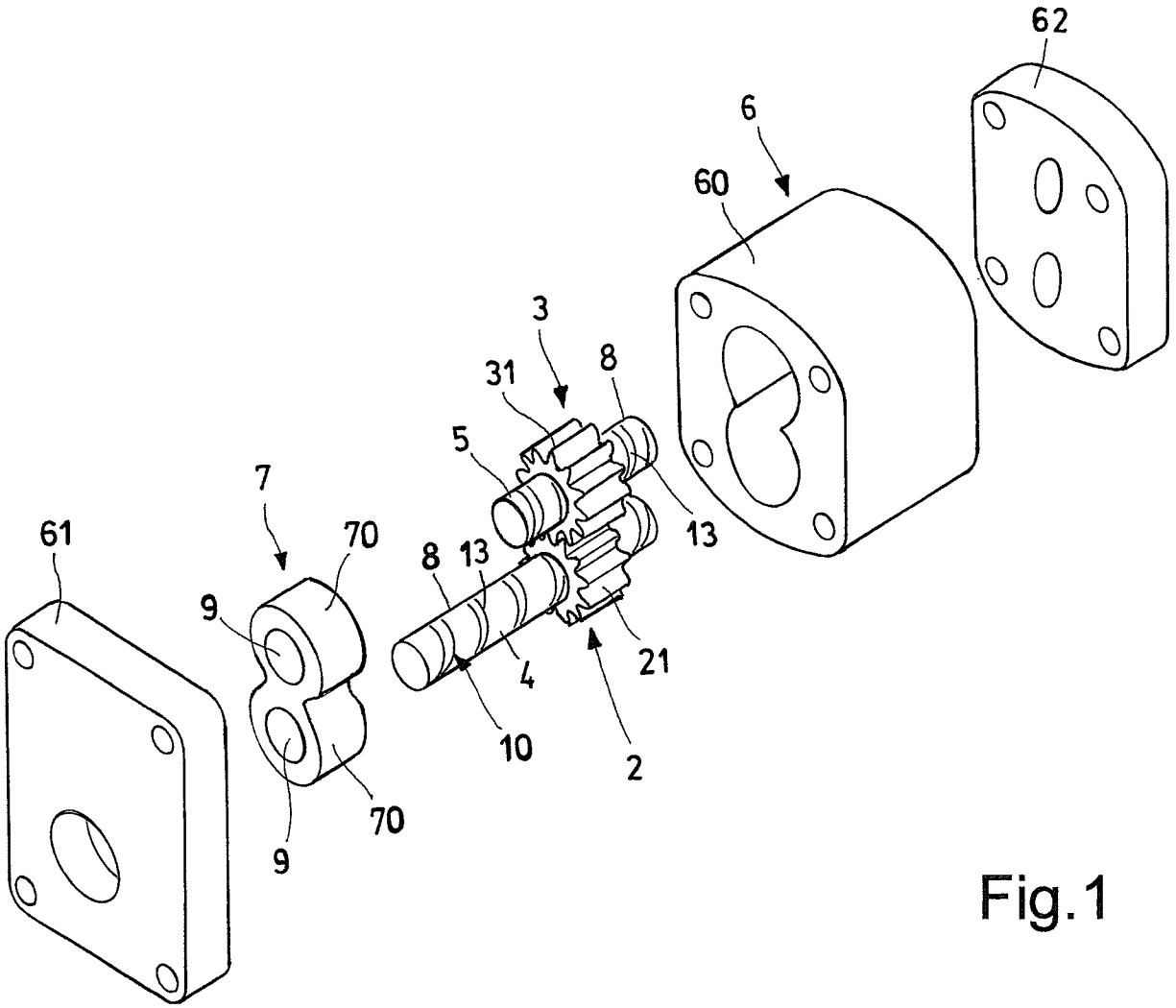
FIG. 1 is an exploded, simplified perspective view of an embodiment of a pump according to the disclosure.

With reference to the above figures, the pump, particularly for pumping a liquid such as ink, paint, glue or the like, generally designated by the reference numeral 1, comprises at least one rotating pumping member 2, 3 comprising a respective shaft 4, 5. The at least one rotating pumping member 2, 3 is at least partially housed inside a pump body 6. The shaft 4, 5 is rotatably supported by at least one support 7 associated with the pump body 6.

According to the disclosure, the shaft 4, 5 comprises, on its external cylindrical surface 8 in contact with the liquid, one or more recesses 10, or the at least one support 7 comprises, on its internal surface 9 in contact with the liquid, one or more recesses 20.

Advantageously, the presence of one or more recesses 10, 20 on the external surface 8 of the shaft 4, 5 or on the internal surface 9 of the support 7 allows to render discontinuous the layer of liquid being deposited on the external surface 8 of the shaft 4, 5 or on the internal surface 9 of the support 7, as well as, in particular, the layer of liquid being deposited in the gap between the external surface 8 of the shaft 4, 5 and the internal surface 9 of the support 7 in the zone in which said surfaces 8, 9 face one another.

The presence of the recesses 10, 20 makes the motion of the liquid near the shaft 4, 5 or the support 7 turbulent, thus preventing the deposition thereof on the walls of the shaft 4, 5 and/or of the support 7.

Advantageously, both one or more recesses 10 can be provided on the external cylindrical surface 8 of the shaft 4, 5 as well as one or more recesses 20 on the internal cylindrical surface 9 of the support structure 7.

Preferably, the shaft 4, 5 is supported by a pair of supports 7, mutually spaced apart along the direction of longitudinal development of the shaft 4, 5. Advantageously, at least one of the supports 7 is arranged at an axial end of the shaft 4, 5.

Advantageously, the pump 1 can be a volumetric pump, for example a lobe pump, a vane pump, or an internal or external gear pump.

The example shown in FIG. 1 relates to a volumetric gear pump 1 comprising a driven rotating pumping member 2 and an idle rotating pumping member 3.

In this case, the rotating pumping members 2 and 3 each comprise a gear wheel 21, 31 which can be keyed to the respective shaft 4, 5 or made as a single piece with the respective shaft 4, 5.

In an alternative embodiment not shown in the accompanying figures, the pump 1 may be a centrifugal pump. In this case, the rotating pumping member may comprise an impeller, or a turbine, keyed on a shaft, or made as a single piece with the shaft.

Advantageously, the support 7 is defined by a seat obtained in the pump body 6 and/or by a bearing 70 fixed to the pump body 6.

Advantageously, this seat can be configured to accommodate an intermediate portion or an end of a shaft 4, 5 or to accommodate a bearing 70 in which the shaft 4, 5 is in turn rotatably supported.

Advantageously, the bearing 70 can be a sliding bearing, or a rolling bearing.

Advantageously, as shown in the example of FIG. 1, the pump body 6 comprises a hollow central body 60 and a pair of covers 61, 62 opposite the central body 60. One of these covers 61, 62 can be made in one piece with the central body 60, while one or both of these covers 61, 62 can in any case be associated with the central body 60 by means of fixing means not shown in the figure, by interposition of liquid-tight elements, also not shown.

In this case, the support structures 7 can be defined by seats obtained integrally as single part in one or both of said covers 61, 62 or by bearings 70 suitably fixed to one or both of said covers 61, 62.

Advantageously, the one or more recesses 10 are distributed at least on the portion of the external cylindrical surface 8 of the shaft 4, 5 which faces the internal cylindrical surface 9 of the support 7.

Similarly, the one or more recesses 20 are distributed at least on the internal cylindrical surface portion 9 of the support 7 that faces the external cylindrical surface 8 of the shaft 4, 5.

Advantageously, the one or more recesses 10, 20 are distributed over the entire external cylindrical surface 8 of the shaft 4, 5 which is in contact with the liquid, i.e. they are distributed both on the external surface portion 8 which faces the internal surface 9 of the support 7, and on the portion of the external surface 8, possibly exposed, inside the pump body 6 with respect to the support 7.

If two rotating pumping members 2, 3 and therefore at least two supports 7, and preferably two pairs of supports 7—one pair for each shaft 4 and 5—are present, the one or more recesses 10, 20 are advantageously present on both shafts 4 and 5 of the two rotating pumping members 2, 3 or on all the supports 7 present in the pump 1.

Advantageously, the one or more recesses 10, 20 are defined by one or more facets 12 or grooves 13, 23 having a mainly longitudinal development with respect to the axis of the shaft 4, 5 and/or to the central axis of the support 7.

In an alternative embodiment, not shown, the one or more recesses 10, 20 comprise a plurality of grooves which are mainly transversal with respect to the axis of the shaft 4, 5 and/or to the central axis of the support 7, such as for example circumferential grooves.

Advantageously, the pump 1 can comprise a plurality of combinations of grooves having both a longitudinal and a transversal development.

Figure 2:
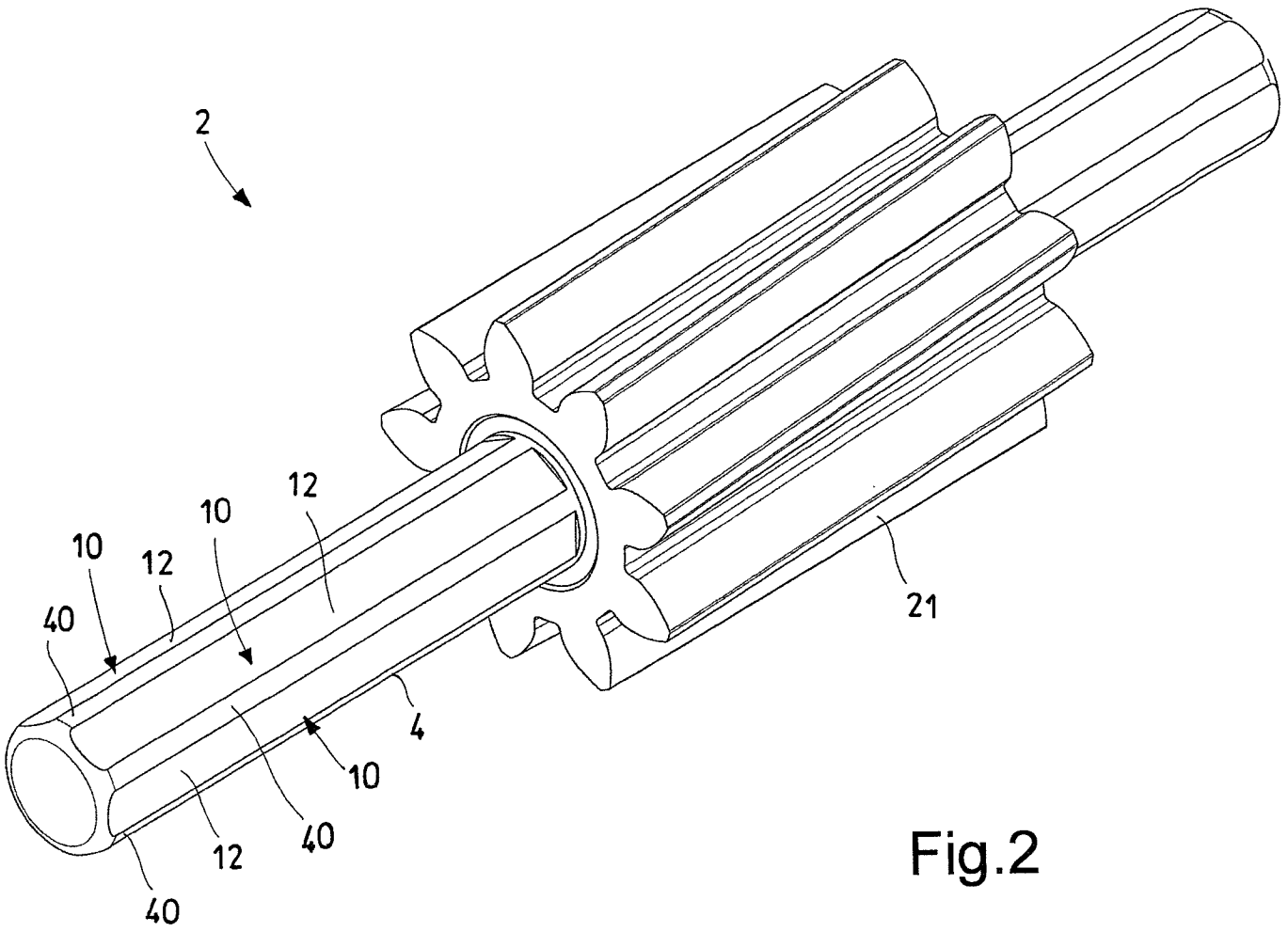
FIG. 2 is a perspective view of a shaft with gear wheel present in the pump according to the disclosure.
Figure 3:
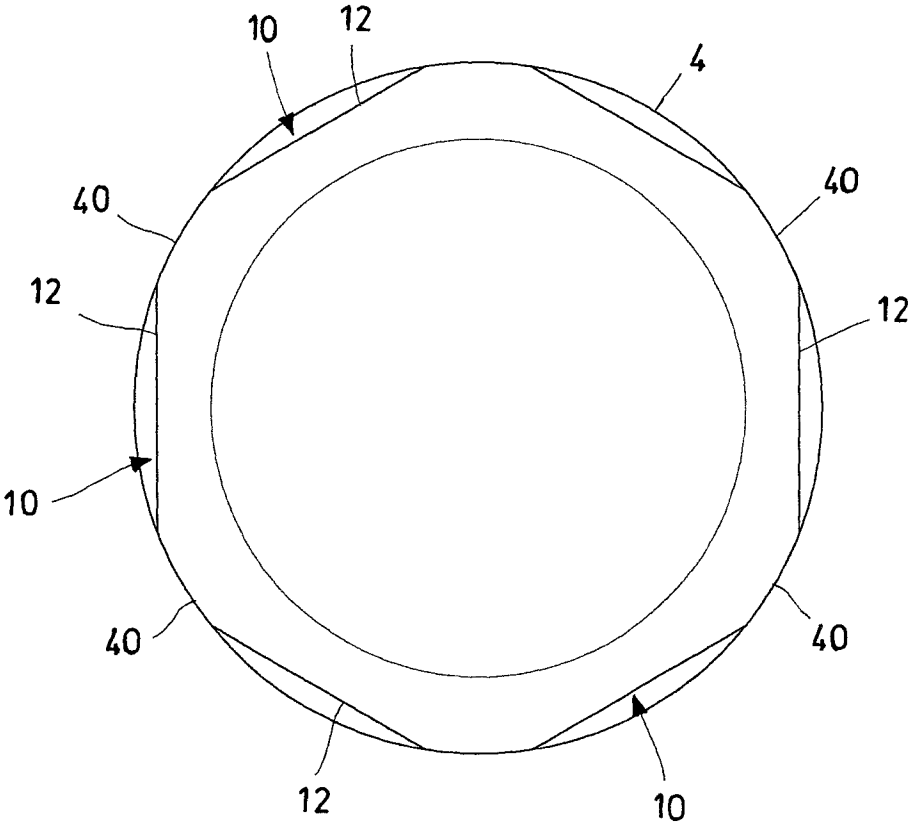
FIG. 3 is a front view of the shaft shown in FIG. 2.
Figure 5:
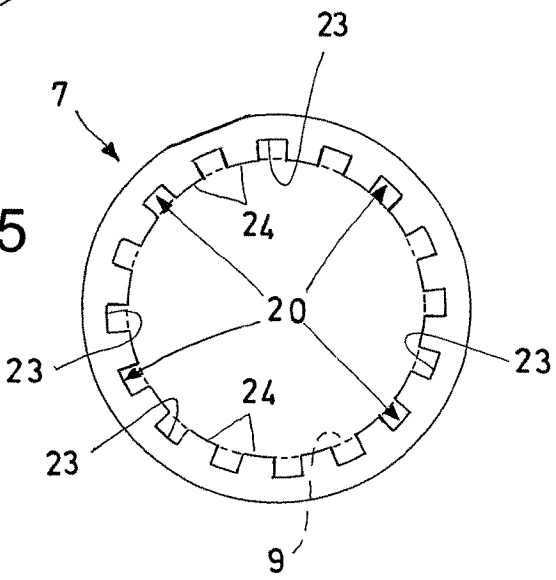
FIG. 5 is a cross-sectional view of a support rotatably housing a portion of a shaft of a rotating pumping member, present in the pump according to the disclosure.

Advantageously, as shown in particular in FIGS. 2, 3 and 5, the one or more recesses 10, 20 comprise a plurality of facets 12 or grooves 23 having a longitudinal development substantially parallel to the axis of the shaft 4, 5.

For example, FIGS. 2 and 3 show a shaft 4 in which the recesses 10 are defined by a plurality of facets 12 having a longitudinal development, substantially parallel to the axis of the shaft 4.

Similarly, FIG. 5 shows a support 7 in which there is a plurality of grooves 23 developing longitudinally parallel to the axis of the shaft 4, when it is accommodated in the relative support 7, or in any case parallel to the central axis of the support 7.

Advantageously, the facets 12 or the grooves 23 having a longitudinal development substantially parallel to the axis of the shaft 4 are distributed according to a radial symmetry with respect to the axis of the shaft 4 or to the central axis of the support 7.

As shown in the example of FIGS. 2 and 3, the shaft 4 has a polygonal, for example hexagonal, cross-section, the vertices 40 of which, as explained more clearly below, are rounded so that they define a contact surface with the support 7 lying on the external cylindrical surface 8 of the shaft 4. The polygonal section advantageously has a number of sides greater than or equal to 3, preferably greater than 5.

Similarly, as regards the example of FIG. 5, the portions 24 of the support 7 interspersed to the grooves 23 have a contact surface with the shaft 4 lying on the internal cylindrical surface 9 of the shaft 4.

Advantageously, as shown in FIG. 1, the one or more recesses 10, 20 can be defined by at least one groove 13 having a helical development, which affects the external cylindrical surface 8 of the shaft 4, 5, or the internal cylindrical surface 9 of the support 7.

Figure 4:
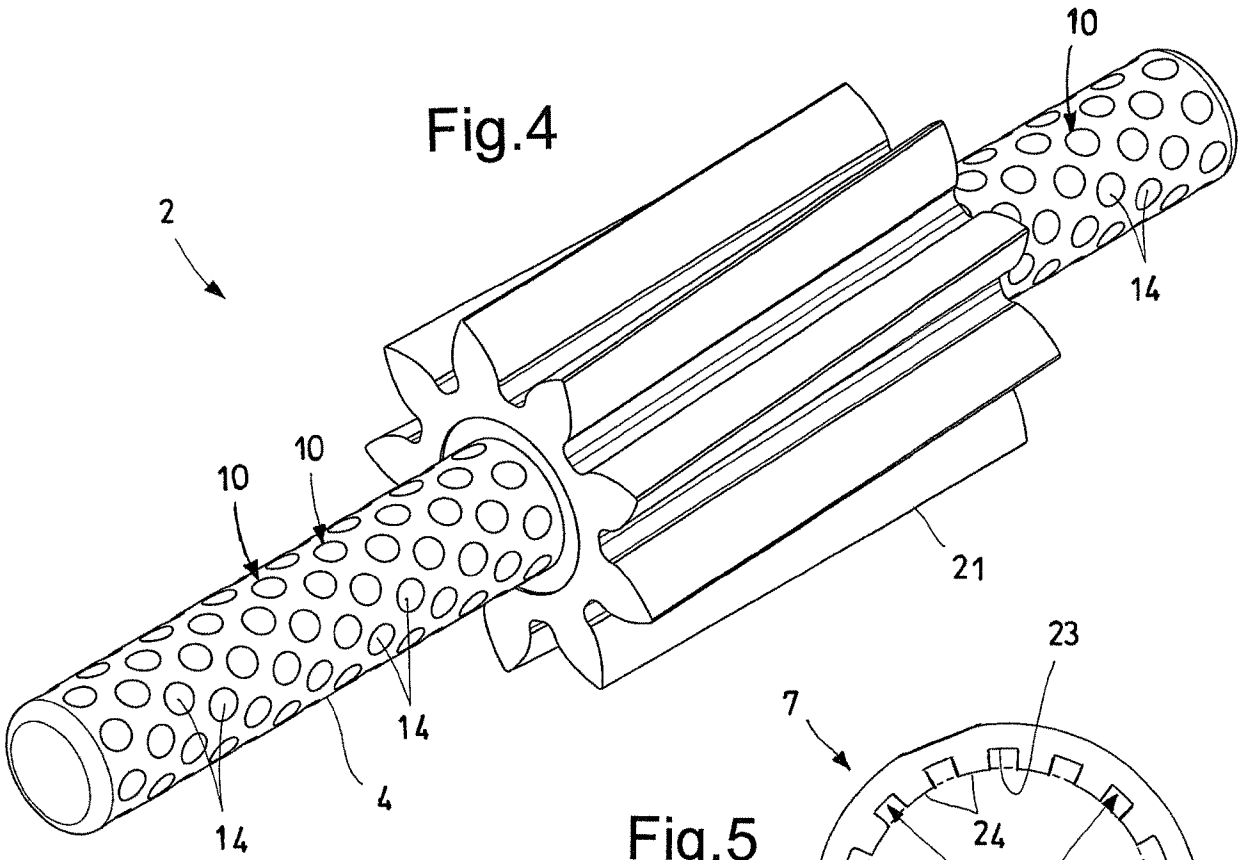
FIG. 4 is a perspective view of a variant of a shaft with gear wheel present in the pump according to the disclosure.

Advantageously, the one or more recesses 10, 20 can be defined by a plurality of pits 14 configured as a cup or in similar forms, preferably with a substantially hemispherical profile, as shown in the example of FIG. 4.

According to further embodiments, not shown, the one or more recesses 10, 20 can be defined by knurlings or other geometric discontinuities present on the cylindrical surfaces 8, 9 of the shaft 4, 5 or of the support structure 7.

Advantageously, the one or more recesses 10 of the shaft 4, 5 are distributed on the external cylindrical surface 8 of the shaft 4, 5 so as to maintain at least a portion of said external cylindrical surface 8 in contact with the respective internal cylindrical surface 9 of said at least one support structure 7 in each relative position between the shaft 4, 5 and the respective support 7.

Similarly, the one or more recesses 20 of the support 7 are distributed on the internal cylindrical surface 9 of the support 7 so as to maintain at least a portion of the internal cylindrical surface 9 in contact with the respective external cylindrical surface 8 of the shaft 4, 5 in any relative position between the shaft 4, 5 and the respective support 7.

In other words, at least on a certain fraction of the length of the shaft 4, 5 there are zones of the shaft 4, 5 which form part of the external cylindrical surface 8 so as to maintain circular contact points between the shaft 4, 5 and the support 7 suitably distributed on the surfaces 8 and 9.

The operation of the pump 1, with specific reference to the presence of the recesses 10, 20, is clear and evident from what has been described.

In particular, the presence of these recesses 10, 20 generates, during the rotation of the rotating pumping member 2, 3, turbulent motions inside the liquid such as to cause a discontinuity in the fluid vein present at least in the gap between shafts and supports so as to prevent the "deposition" of a layer of liquid on the surfaces of such components.

Such turbulent motion is generated when the shaft 4, 5 rotates about its own axis, both in the case in which the recesses 10 are arranged on the shaft 4, 5 and in the case in which they are arranged in the support 7. In particular, in this second case, the motion of the liquid inside the gap is imposed by the rotation of the shaft 4, 5, but the recesses 20 present in the support 7, although it is fixed, nevertheless generate a turbulence to the motion of the liquid itself.

In practice it has been found that the pump particularly for pumping a liquid such as ink, paint, glue or the like, according to the present disclosure, achieves the intended task and advantages, since it allows preventing the "deposition" phenomena occurring during the operations of pumping these types of liquids.

A further advantage of the pump, according to the disclosure, is the fact that the presence of the recesses on the components in relative motion to each other allows to considerably reduce, until almost eliminate the variation in viscosity of a non-Newtonian fluid (which would appear due to the shear forces imposed on the liquid itself). Such a reduction in the viscosity of the pumped liquid results in a further reduction in the resistance to the motion of the liquid and, ultimately, to the relative motion among the components.

Another advantage of the pump, according to the disclosure, is the fact of having reduced wear phenomena and of preventing operating blocks, thanks to the prevention of the deposition of the thin layer of liquid in the gap between the components in relative motion.

The pump particularly for pumping a liquid such as ink, paint, glue or the like, thus conceived is susceptible of numerous modifications and variations, all of which are within the scope of the inventive concept.

Furthermore, all the details can be replaced by other technically equivalent elements.

In practice, any materials can be used according to requirements, as long as they are compatible with the specific use, the dimensions and the contingent shapes.

The invention claimed is:

1. A pump configured to pump a liquid, comprising at least one rotating pumping member comprising a respective shaft, said at least one rotating pumping member being at least partially housed inside a pump body, said shaft being rotatably supported by at least one support associated with said pump body, wherein said shaft comprises, on its external cylindrical surface in contact with said liquid, one or more recesses, or wherein said at least one support comprises, on its internal cylindrical surface in contact with said liquid, one or more recesses, said pump further comprising a liquid-tight component disposed over the pump body and configured to seal the pump, wherein said one or more recesses comprise a plurality of facets or grooves having a longitudinal development substantially parallel to the axis of said shaft, wherein said one or more recesses are defined by said grooves present on said internal cylindrical surface of said support, said grooves being distributed according to a radial symmetry with respect to the central axis of said support, wherein said one or more recesses are distributed over the entire external cylindrical surface of said shaft which is in contact with said liquid.

2. The pump, according to claim 1, wherein said at least one support is defined by a seat obtained in said pump body or by a bearing fixed to said pump body.

3. The pump, according to claim 1, wherein said one or more recesses are distributed at least on the portion of the external cylindrical surface of said shaft which faces the internal cylindrical surface of said at least one support, or distributed at least on the portion of the internal cylindrical surface of said at least one support that faces the external cylindrical surface of said shaft.

4. The pump, according to claim 1, wherein said one or more recesses are defined by one or more facets or grooves having a mainly longitudinal development.

5. The pump, according to claim 1, wherein said one or more recesses are defined by a plurality of pits configured as a cup, preferably with a substantially hemispherical profile.

6. The pump, according to claim 1, wherein said liquid is a non-Newtonian fluid.

7. A pump for pumping a liquid, comprising at least one rotating pumping member comprising a respective shaft, said at least one rotating pumping member being at least partially housed inside a pump body, said shaft being rotatably supported by at least one support associated with said pump body, wherein said shaft comprises, on its external cylindrical surface in contact with said liquid, one or more recesses, or wherein said at least one support comprises, on its internal cylindrical surface in contact with said liquid, one or more recesses, wherein said one or more recesses comprise a plurality of facets or grooves having a longitudinal development substantially parallel to the axis of said shaft, and wherein said one or more recesses are defined by said facets present on said external cylindrical surface of said shaft, said facets being distributed according to a radial symmetry with respect to the axis of said shaft, said shaft having a polygonal cross-section having a number of sides greater than or equal to 3, wherein said vertices of said polygonal cross-section are rounded so as to define a contact surface with said support lying on said external cylindrical surface of said shaft.

8. A pump configured to pump a liquid, comprising at least one rotating pumping member comprising a respective shaft, said at least one rotating pumping member being at least partially housed inside a pump body, said shaft being rotatably supported by at least one support associated with said pump body, wherein said shaft comprises, on its external cylindrical surface in contact with said liquid, one or more recesses, or wherein said at least one support comprises, on its internal cylindrical surface in contact with said liquid, one or more recesses, said pump further comprising a liquid-tight component disposed over the pump body and configured to seal the pump, wherein said one or more recesses comprise a plurality of grooves having a mainly transversal development, preferably circumferential.

9. A pump configured to pump a liquid, comprising at least one rotating pumping member comprising a respective shaft, said at least one rotating pumping member being at least partially housed inside a pump body, said shaft being rotatably supported by at least one support associated with said pump body, wherein said shaft comprises, on its external cylindrical surface in contact with said liquid, one or more recesses, or wherein said at least one support comprises, on its internal cylindrical surface in contact with said liquid, one or more recesses, said pump further comprising a liquid-tight component disposed over the pump body and configured to seal the pump, wherein said one or more recesses comprise a plurality of facets or grooves having a longitudinal development substantially parallel to the axis of said shaft, wherein said one or more recesses are defined by said grooves present on said internal cylindrical surface of said support, said grooves being distributed according to a radial symmetry with respect to the central axis of said support, wherein said one or more recesses are distributed on said external cylindrical surface of said shaft so as to maintain at least a portion of said external cylindrical surface in contact with the respective internal cylindrical surface of said at least one support in each relative position between said shaft and the respective support.

* * * * *